United States Patent [19]

Ohshio et al.

[11] Patent Number: 4,862,337

[45] Date of Patent: Aug. 29, 1989

[54] AUTOMOTIVE LAMP ASSEMBLY

[75] Inventors: Hirohiko Ohshio; Horoyuki Makita; Hidehiko Nagasawa; Yoshiki Kurosawa; Yoshinobu Koyanagi, all of Shimizu, Japan

[73] Assignee: Koito Seisakusho Co., Ltd., Tokyo, Japan

[21] Appl. No.: 154,556

[22] Filed: Feb. 10, 1988

[30] Foreign Application Priority Data

| | | | |
|---|---|---|---|
| Feb. 10, 1987 | [JP] | Japan | 62-18590[U] |
| Feb. 12, 1987 | [JP] | Japan | 62-29983 |
| May 1, 1987 | [JP] | Japan | 62-108588 |
| Dec. 28, 1987 | [JP] | Japan | 62-200022[U] |

[51] Int. Cl.[4] ..... F21V 29/00

[52] U.S. Cl. ..... 362/294; 362/80; 362/310; 362/345

[58] Field of Search ..... 362/61, 80, 227, 240, 362/294, 310, 345, 373

[56] References Cited

U.S. PATENT DOCUMENTS

| | | | |
|---|---|---|---|
| 4,569,007 | 2/1986 | Dick | 362/294 |
| 4,635,173 | 1/1987 | Dressler et al. | 362/294 |

*Primary Examiner*—Stephen F. Husar

*Attorney, Agent, or Firm*—Sughrue, Mion, Zinn, Macpeak & Seas

[57] ABSTRACT

Herein disclosed is an automotive headlamp assembly of a so-called ventilation type. The assembly comprises a body structure having an open chamber formed therein, a lens attached to the body structure to cover the open chamber thereby to form in the body structure an enclosed chamber, an electric bulb arranged in the enclosed chamber, and first and second pipe members each having on end projected into the enclosed chamber and the other end exposed to the atmosphere. The other end of the second pipe member is so constructed and arranged that when a certain air flow passes through the other end, a negative pressure is produced around the same.

40 Claims, 23 Drawing Sheets

AUTOMOTIVE LAMP ASSEMBLY

BACKGROUND OF THE INVENTION

1. Field of the Invention

The present invention relates in general to automotive lamp assemblies, and more particularly, to automotive lamp assemblies of a type which is constructed to eliminate or at least minimize a collection of moisture on surfaces of the lens and reflector installed in the lamp assembly.

2. Description of the Prior Art

In lamp assemblies, particularly in automotive headlamp assemblies, a considerable change of temperature is produced in the interior thereof between ON and OFF conditions of the lamp bulb installed therein. However, such temperature change induces a collection of moisture on inner surfaces of the lens and reflector in the assembly due to a trace of water inevitably contained in the assembly. The collected moisture causes deterioration in not only reflection of the light on the reflector but also transmission of the light through the lens.

Thus, hitherto, various attempts have been made for eliminating such undesirable moisture collection phenomenon of the lamp assembly. One of them is to provide the lamp assembly with a hermetically sealed construction to shut out water. However, it is quite difficult and expensive to produce a lamp assembly which can completely shut out the water.

In view of the above, a so-called "ventilation type assembly" has been proposed, which is constructed to permit flowing of the outside air through the interior of the assembly. In this type lamp assembly, inlet and outlet pipes are connected to the lamp assembly to provide a ventilation passage through the interior of the lamp assembly, and the air in the passage is forced to flow therethrough by force of convection of air in the assembly, which convection is created by heat generated by the electric bulb under energization. However, even in the lamp assemblies of this type, satisfactory performance has not been obtained due to the inherency in construction thereof.

SUMMARY OF THE INVENTION

It is therefore an object of the present invention to provide an automotive lamp assembly of the above-mentioned ventilation type, which exhibits satisfied performance in removing the undesired collection of moisture on the lens and the reflector by using a negative pressure generated near the lamp assembly during running of the vehicle.

It is another object of the present invention to provide an automotive lamp assembly of the ventilation type, which is constructed to prevent the interior of the lamp assembly from being contaminated with water and dust.

It is still another object of the present invention to provide an automotive lamp assembly of the ventilation type, which can quickly remove the collection of moisture in the lamp assembly.

It is a further object of the present invention to provide an automotive lamp assembly of the ventilation type, in which inlet and outlet pipes of the ventilation passage are so arranged as not to deteriorate the light reflecting performance of a light reflector installed in the lamp assembly.

According to the present invention, there is provided an automotive lamp assembly which comprises a body structure having an open chamber formed therein, a lens attached to the body structure to cover the open chamber thereby to form an enclosed chamber in the body structure, an electric bulb arrange n the enclosed chamber, a first pipe member having one end projected into a first given portion of the enclosed chamber and the other end open to the atmosphere, a second pipe member having one end projected into a second given portion of the enclosed chamber and the other end open to the atmosphere, and means for producing a negative pressure in the other end of the second pipe member when a certain air flow passes through the same.

BRIEF DESCRIPTION OF THE DRAWINGS

Other objects and advantages of the present invention will become apparent from the following description when taken in conjunction with the accompanying drawings, in which:

FIGS. 1 to 8 are drawings showing an automotive head lamp assembly of a first embodiment of the present invention, wherein:

FIG. 1 is an exploded perspective view of the head lamp assembly;

FIG. 2 is a horizontally sectional view of the head lamp assembly;

FIG. 3 is a sectional view taken along the line III—III of FIG. 2;

FIG. 4 is an enlarged sectional view of the part indicated by the arrow IV of FIG. 2, showing an air inlet pipe connected to a lamp body;

FIG. 5 is a sectional view of the air inlet pipe;

FIG. 6 is a back view of an air outlet pipe;

FIG. 7 is a side view of the air outlet pipe; and

FIG. 8 is a sectional view taken along the line VII—VII of FIG. 6; and

FIGS. 9 to 18 are drawings showing an automotive head lamp assembly of a second embodiment of the present invention, wherein:

FIG. 9 is an exploded perspective view of the head lamp assembly;

FIG. 10 is a horizontally sectional view of the head lamp assembly;

FIG. 11 is a sectional view taken along the line XI—XI of FIG. 10;

FIG. 12 is a sectional view of an air outlet pipe connected to the head lamp assembly;

FIG. 13 is a partial perspective view of the head lamp assembly, but showing a first modification of a lamp body employable in the assembly;

FIG. 14 is a partial perspective view of the head lamp assembly, but showing a second modification of the lamp body;

FIG. 15 is a sectional view of an air duct employed in the second modification of FIG. 14;

FIG. 16 is a back view of a modified air outlet pipe employable in the head lamp assembly;

FIG. 17 is a back view of a modified air inlet pipe employable in the head lamp assembly; and FIG. 18 is a sectional view taken along the line XVIII—XVIII of FIG. 17;

FIGS. 19 to 25 are drawings showing an automotive head lamp assembly of a third embodiment of the present invention, wherein:

FIG. 19 is an exploded perspective view of the head lamp assembly;

FIG. 20 is a horizontally sectional view of the head lamp assembly;

FIG. 21 is a sectional view taken along the line XXI—XXI of FIG. 20;

FIG. 22 is a partial perspective view of the head lamp assembly, but showing a first modification of a lamp body employable in the assembly;

FIG. 23 is a partial perspective view of the head lamp assembly, but showing a second modification of the lamp body;

FIG. 24 is a back view of a modified air inlet pipe employable in the head lamp assembly; and FIG. 25 is a sectional view taken along the line XXV—XXV of FIG. 24; and FIGS. 26 to 34 are drawings showing an automotive head lamp assembly of a fourth embodiment of the present invention, wherein:

FIG. 26 is an exploded perspective view of the head lamp assembly;

FIG. 27 is a horizontally sectional view of the head lamp assembly;

FIG. 28 is a sectional view taken along the line XXVIII—XXVIII of FIG. 27;

FIG. 29 is an enlarged sectional view of the part indicated by the arrow XXIX, showing an air inlet pipe connected to a lamp body;

FIG. 30 is a back view of an air outlet pipe;

FIG. 31 is a side view of the air outlet pipe;

FIG. 32 is a sectional view taken along the line XXXII—XXXII of FIG. 30;

FIG. 33 is a cut perspective view of the air outlet pipe; and

FIG. 34 is a cut perspective view of the air inlet pipe.

DETAILED DESCRIPTION OF THE INVENTION

In the following, embodiments of the present invention will be described in detail with reference to the drawings. Throughout the description on the embodiments, like parts and constructions will be designated by the same numerals.

Figure 1:
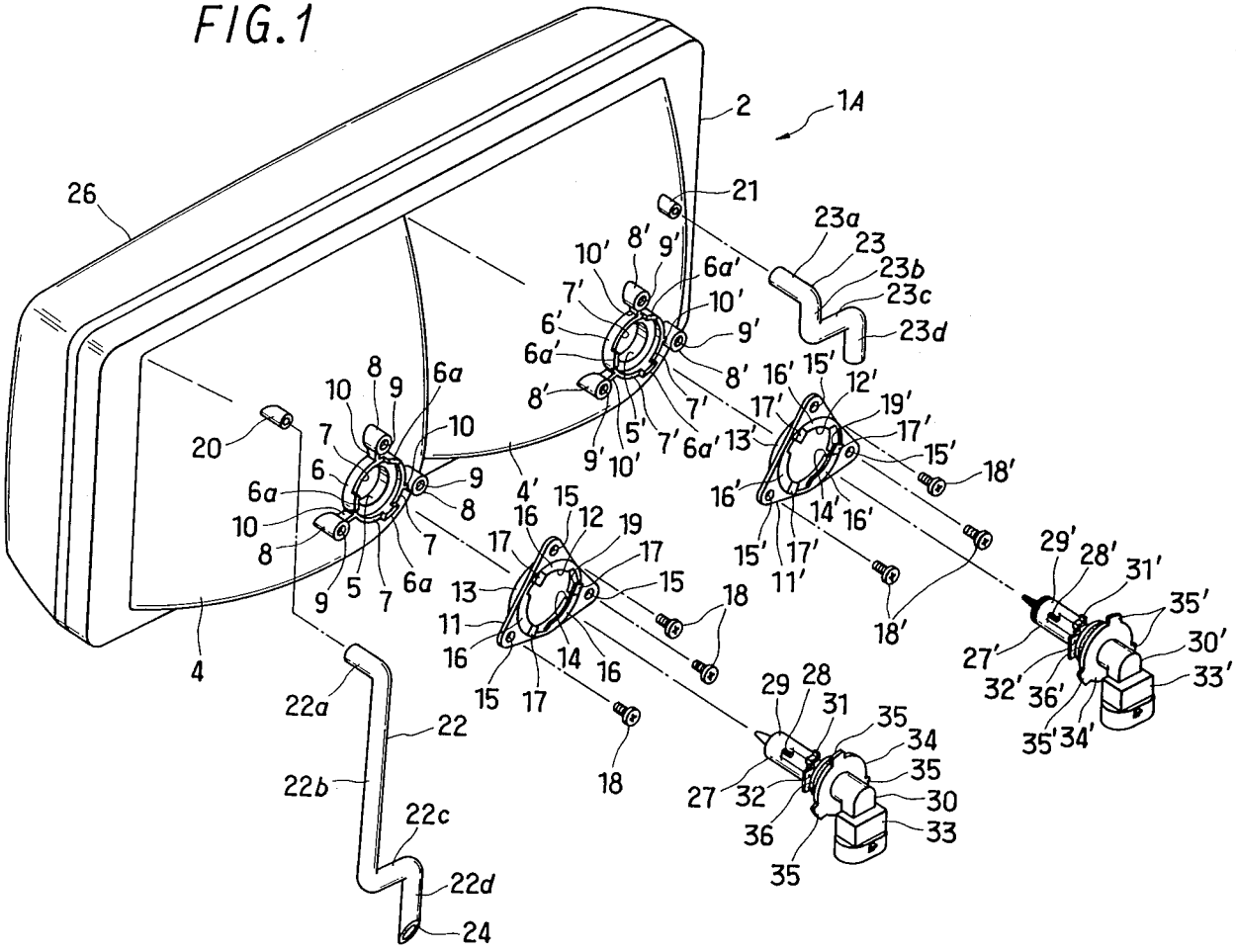
Figure 2:
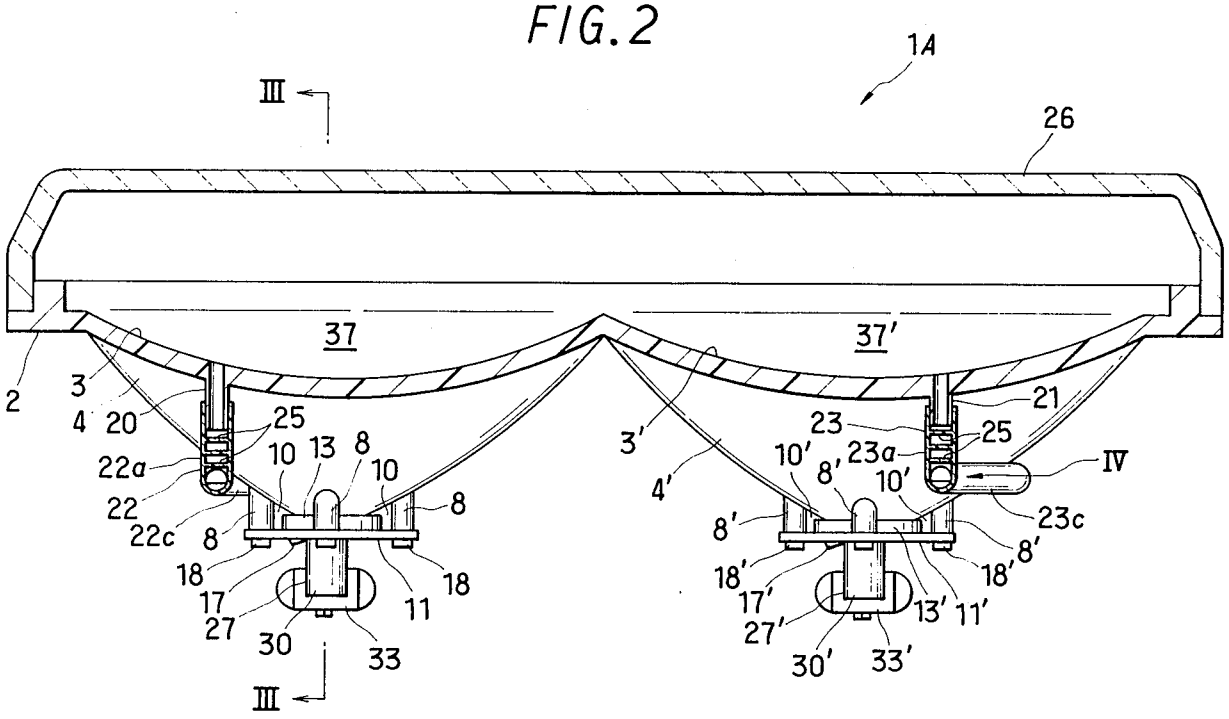
Figure 3:
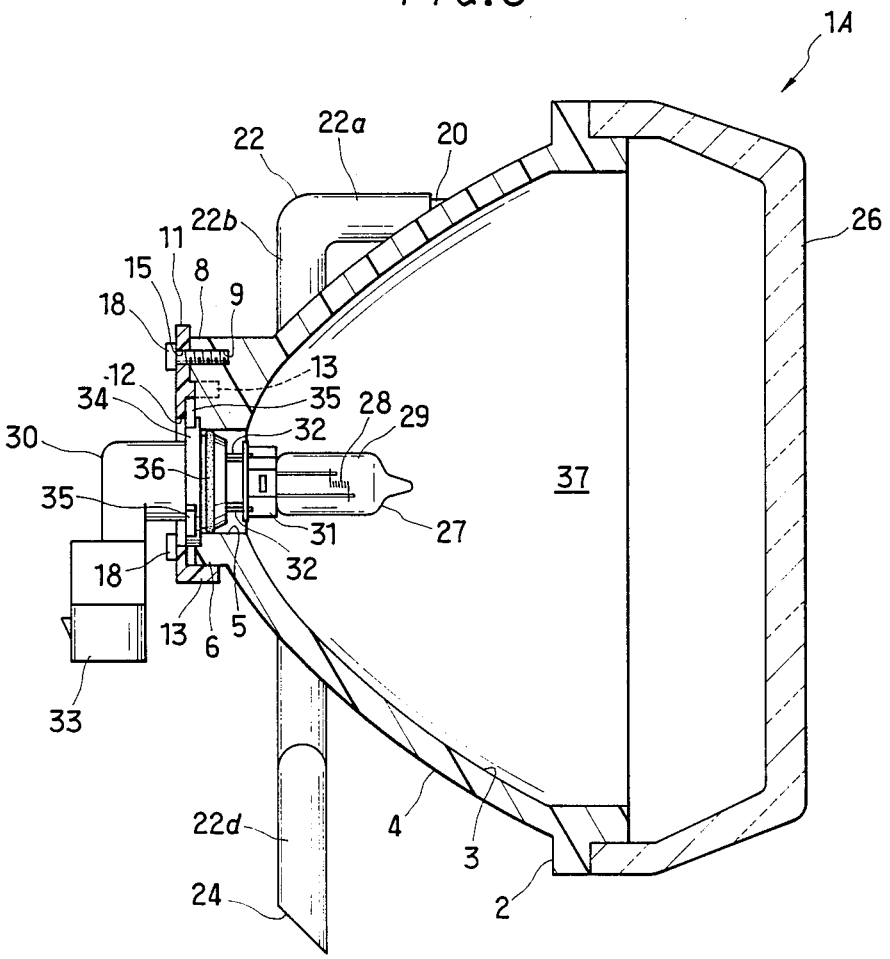

Referring to FIGS. 1 to 8, particularly FIGS. 1 to 3, there is shown an automotive head lamp assembly 1A of a first embodiment of the present invention.

The head lamp assembly 1A is of a dual lamp type and comprises generally a lamp body 2, air inlet and outlet pipes 23 and 22, a lens 26 and electric bulbs 27 and 27', which are constructed and assembled in a manner which will become apparent as the description proceeds.

The lamp body 2 is constructed of, for example, reinforced-plastics, such as a plastic impregnated with glass fiber. The lamp body 2 has a pair of chambered portions 4 and 4' abreast facing forward, each having a front side opened and a rear side closed by a parabolically curved light reflecting surface 3 or 3' (see FIG. 2). The interiors of the chambered portions 4 and 4' are connected to each other through an enclosed space provided between the lens 26 and each chambered portion 4 or 4'.

Each chambered portion 4 or 4' is formed at the rear center portion with a bulb mounting hole 5 or 5'. A rear part of the hole 5 or 5' is defined by an annular wall 6 or 6' which is integrally formed on a rear outer side of chambered portion 4 or 4'. The annular wall 6 or 6' has a rear end formed with three recesses 7 or 7' and three rectangular projections 6*a* or 6*a*', each projection being defined between adjacent two recesses. Three bosses 8 or 8' are integrally formed on the rear outer side of the chambered portion 4 or 4' in a manner to enclose the annular wall 6 or 6'. Each boss 8 or 8' is integrally connected to the annular wall 6 or 6' through a rib 10 or 10' and has a threaded bore 9 or 9' formed therein.

Designated by numerals 11 and 11' are triangular bulb mounting plates, each having at its center portion a circular opening 12 or 12'. Each mounting plate 11 or 11' has an annular wall 13 or 13' projected from a front surface thereof. The annular wall 13 or 13' is so sized as to snugly put therein the annular wall 6 or 6' of the above-mentioned lamp body 2. The annular wall 13 or 13' is formed with three slits 14 or 14', so that upon mounting of the plate 11 or 11' onto the back side of the lamp body 2, these slits 14 or 14' receive therein the ribs 10 respectively. Each plate 11 or 11' is formed with three bolt holes 15 or 15' through which respective bolts 18 or 18' are inserted for meshing engagement with the threaded bores 9 or 9' of the bosses 8 or 8' formed on the lamp body 2. That is, upon mounting of the plate 11 or 11' onto the annular wall 6 or 6' of the lamp body 2, the openings 15 or 15' become mated with the threaded bores 9 or 9' of the bosses 8 or 8'. Three arcuate lugs 16 or 16' are integrally formed on a back surface of the bulb mounting plate 11 or 11' in a manner to surround the circular opening 12 or 12', each having a curved inner side somewhat projected into the opening 12 or 12'. Each lug 16 or 16' is gradually raised from the back side of the plate 11 or 11' as the distance from the root part thereof increases, so that the leading end of each lug 16 or 16' forms a catch portion 17.

In order to tightly mount the bulb mounting plates 11 and 11' on the lamp body 2, the annular wall 13 or 13' of each plate 11 or 11' is snugly coupled with the annular wall 6 or 6' of the lamp body 2 and then the bolts 18 or 18' are passed through the openings 15 or 15' of the plate and screwed into the threaded bores 9 or 9' of the bosses 8 or 8' of the lamp body 2. Under this fixed condition, the arcuate lugs 16 or 16' of the plate 11 or 11' conceal the rear edge portion (viz., the recesses 7 or 7' and the projections 6*a* or 6*a*') of the annular wall 6 or 6' of the lamp body 2, so that there is formed between the top of each projection 6*a* or 6*a*' and the catch portion 17 or 17' of each arcuate lug 16 or 16' a guide slit 19 or 19' the width of which is gradually reduced as the distance from the corresponding recess 7 or 7' reduces.

Designated by numerals 20 and 21 are connecting pipes which are integrally formed on the rear outer surfaces of the chambered portions 4 and 4' respectively. Each pipe 20 or 21 provides a communication between he interior of the chambered portion 4 or 4' and the exterior of the same.

Air outlet and inlet pipes 22 and 23 are detachably connected to the connecting pipes 20 and 21 respectively, which are constructed of an elastomeric material, such as rubber, plastic or the like.

The air outlet pipe 22 comprises an upper horizontal portion 22*a* connected to the connecting pipe 20, an upper elongate vertical portion 22*b* extending downwardly from a rear end of the upper horizontal portion 22*a*, a lower horizontal portion 22*c* extending laterally from a lower end of the upper elongate vertical portion 22*b* and a lower vertical portion 22*d* extending downwardly from a leading end of the lower horizontal portion 22*c*. The lower end 24 of the outlet pipe 22 is obliquely cut with an inclination angle of about 45 degrees. Upon assembly, the oblique lower end 24 is positioned below the lowermost end of the lamp body 2 and faces rearward for the reasons which will be clarified hereinafter.

The air inlet pipe 23 comprises an upper horizontal portion 23*a* connected to the connecting pipe 21, an upper vertical portion 23*b* extending downwardly from a rear end of the upper horizontal portion 23*a*, a lower horizontal portion 23*c* extending laterally from a lower end of the upper vertical portion 23*b* and a lower vertical portion 23*d* extending downwardly from a leading end of the lower horizontal portion 23*c*. Upon assembly, the lower end of the air inlet pipe 23 is positioned above the lower end of the lamp body 2, unlike the case of the air outlet pipe 22. Due to the positional relationship of the air inlet and outlet pipes 23 and 22 relative to the lamp body 2 as described hereinabove,the ventilation of the interior of the lamp body 2 is so made that air is introduced into the lamp body 2 through the inlet pipe 23 and discharged through the outlet pipe 22. The reason of this matter will be described in detail hereinafter.

Figure 4:
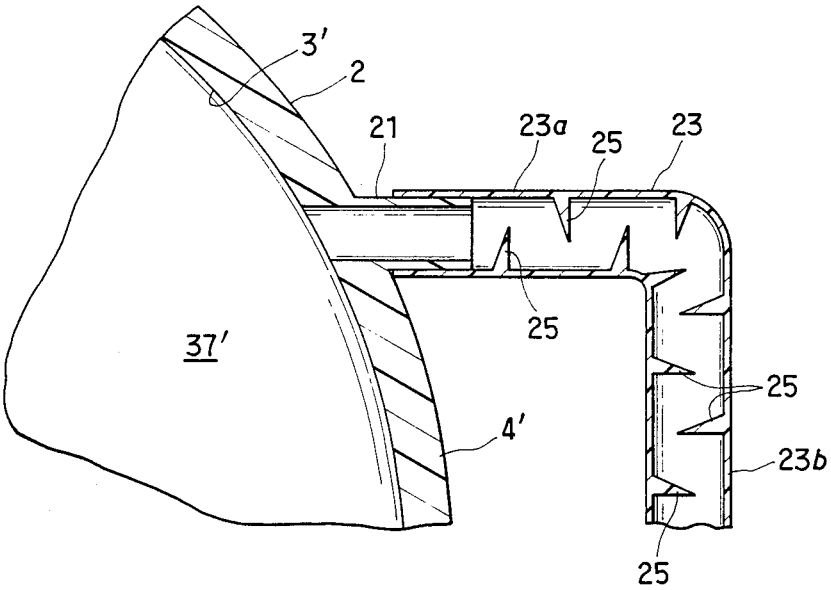
Figure 5:
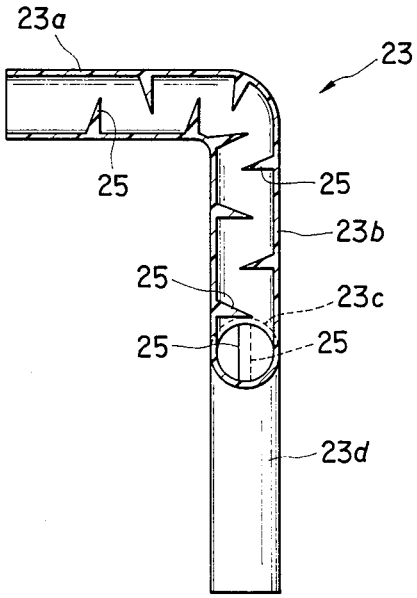
Figure 6:
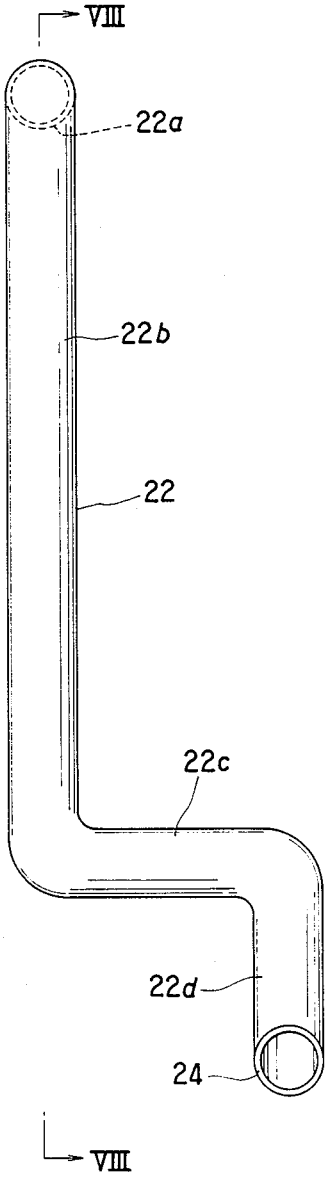
Figure 7:
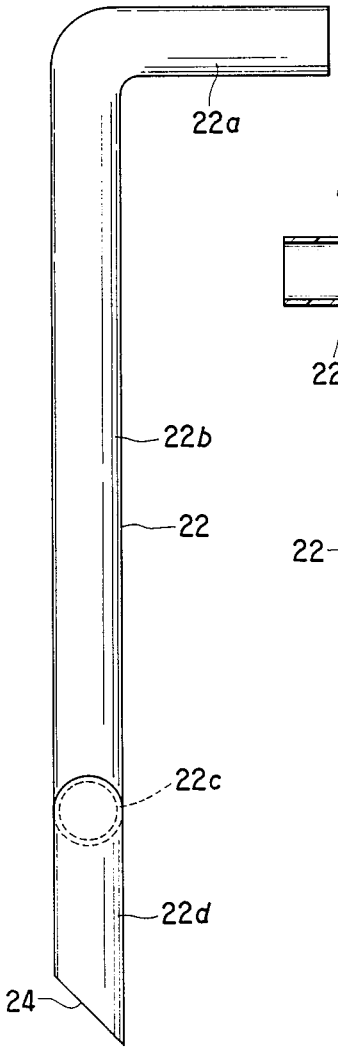
Figure 8:
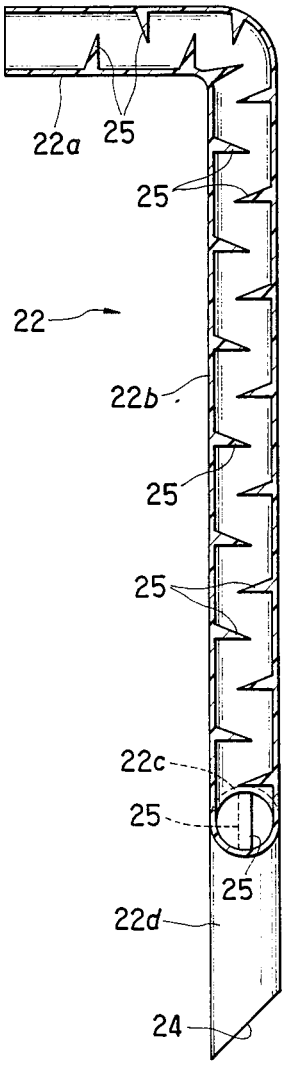
Figure 9:
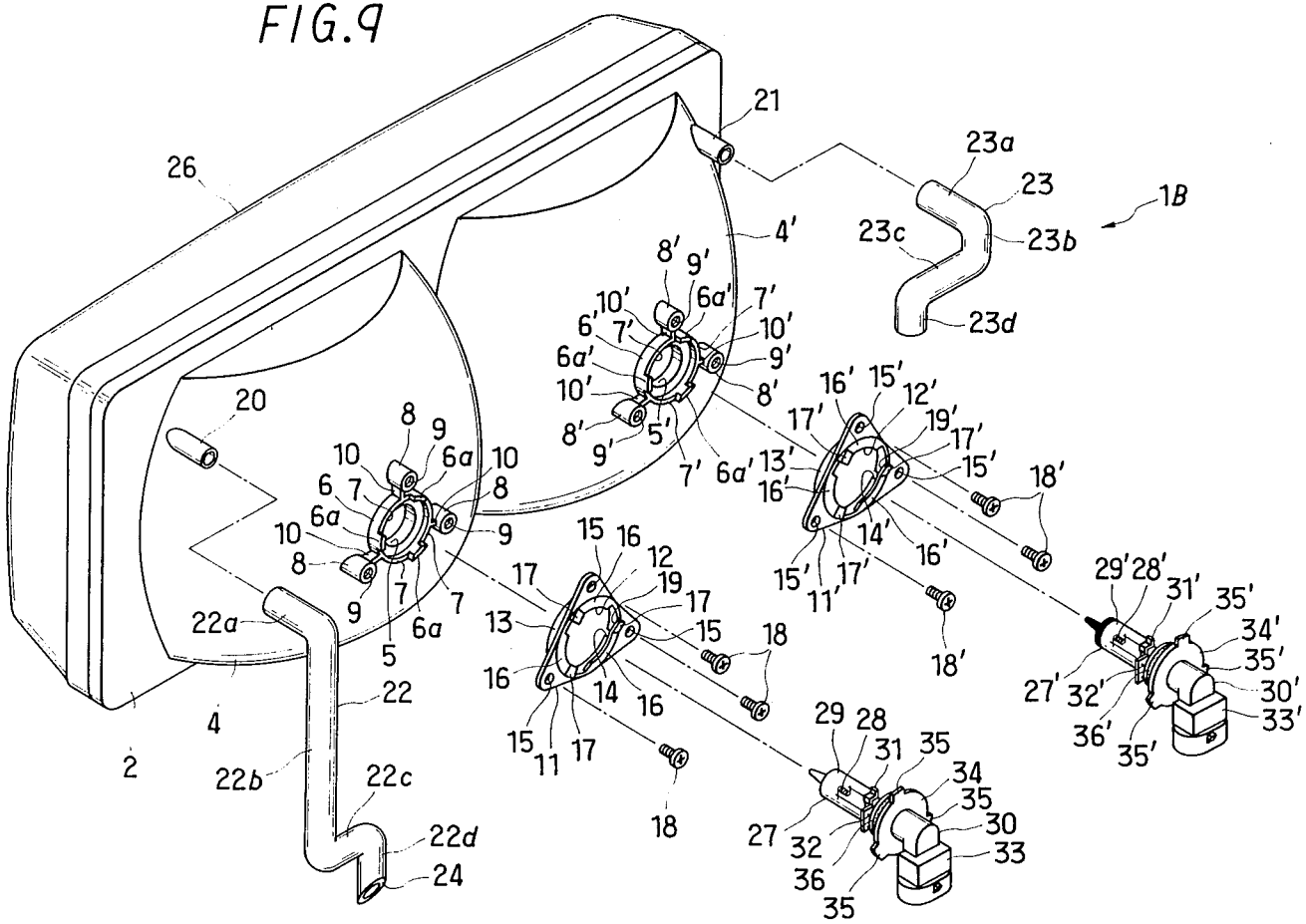
Figure 10:
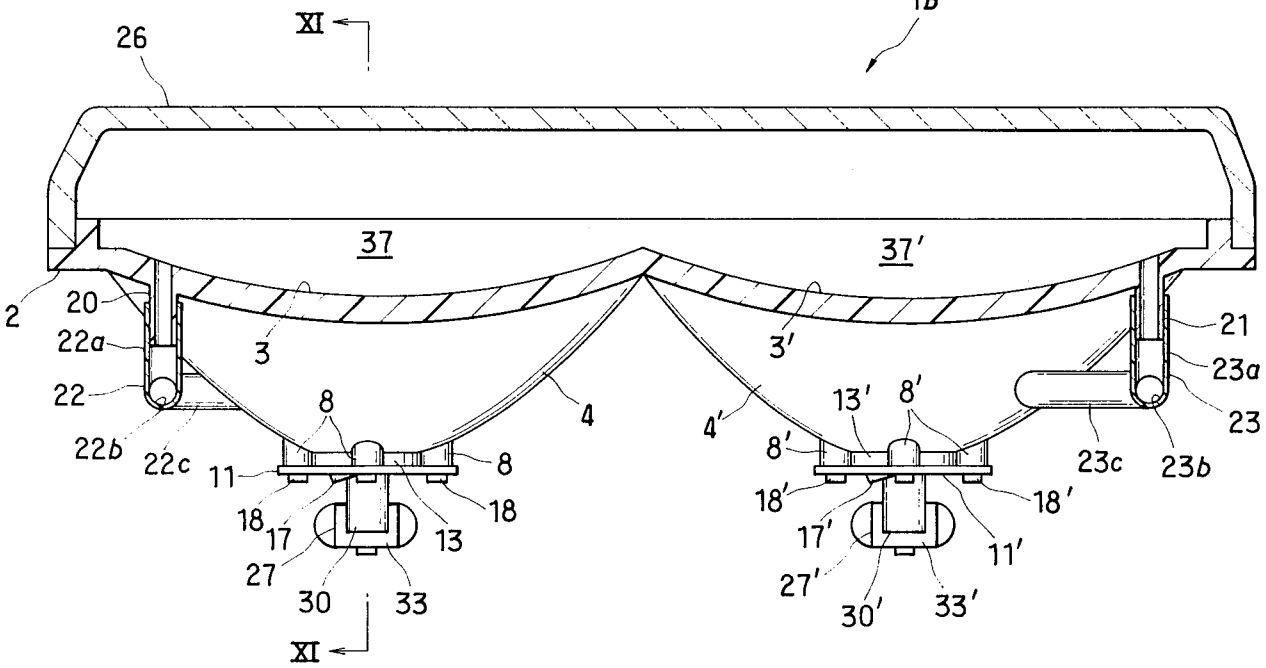
Figure 11:
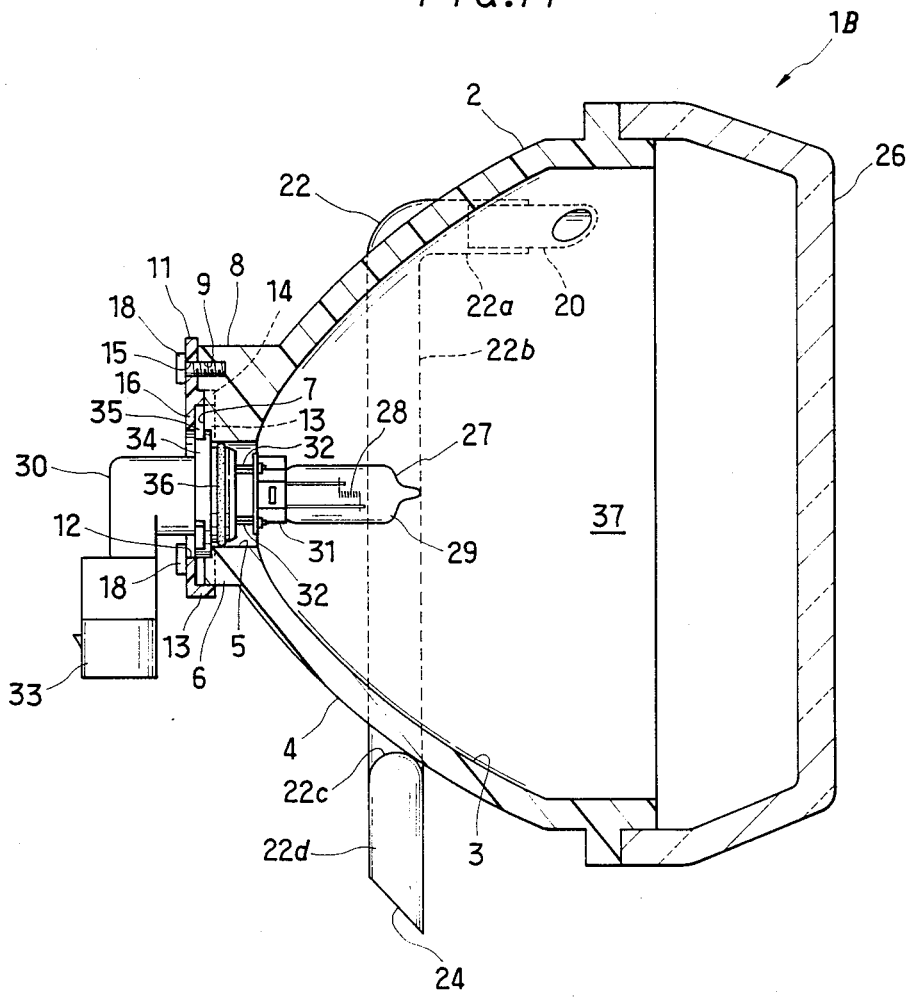
Figure 12:
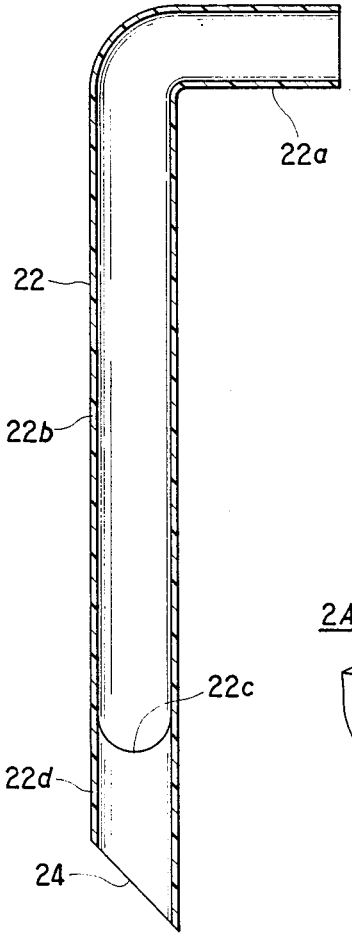

As is seen from FIGS. 4, 5 and 8, within the air inlet and outlet pipes 23 and 22, there are integrally formed a plurality of baffles 25. The baffles 25 are projected inwardly from opposed inner surfaces of each pipe 23 or 22 alternatively. Each baffle 25 is integral with the pipe 23 or 22 and so sized as to extend beyond the center axis of the pipe 23 or 22. That is, each pipe 23 or 22 has thus therein a so-called labyrinth construction. Preferably, each pipe 23 or 22 has an inner diameter ranging from approximately 5 mm to 10 mm.

Referring back to FIGS. 1 to 4, designated by numeral 26 is a lens which is sealingly mounted to the front portion of the lamp body 2 in a known manner.

As is best seen from FIG. 1, designated by numerals 27 and 27' are electric bulb assemblies, each including a hermetically sealed glass tube 29 or 29', a filament 28 or 28' installed int he glass tube, and a plastic base portion 30 or 30' for holding the glass tube. Designated by numeral 31 or 31' is a metal holder wound on a rear part of the sealed glass tube 29 or 29' . The metal holder 31 or 31' is connected to a plurality of supporting pins 32 or 32' (see FIG. 3) extending from a front end of the plastic base portion 30 or 30' thereby to achieve the connection between the sealed glass tube 29 or 29' and the plastic base portion 30 or 30'. The plastic base portion is integrally formed with a connector portion 33 or 33' which houses therein conducting thin plates (not shown). Each conduting plate has one end exposed to the interior of the connector portion 33 or 33' and the other end projected outward from the front end of the plastic base portion 30 or 30' and welded to a lead wire (not shown) led from the sealed glass tube 29 or 29'.

As is best seen from FIG. 1, the plastic base portion 30 or 30' is provided at the front end thereof with a flange 34 or 34' which has three spaced engaging lugs 35 or 35' formed thereon. Each lug 35 or 35' is sized to match with the afore-mentioned recess 7 or 7' formed in the annular wall 6 or 6' of the lamp body 2. Designated by numeral 36 or 36' is an O-ring of resilient material, which is rotatably mounted on the front portion of the plastic base portion 30 or 30'.

In order to mount the electric bulb assembly 27 or 27' to the lamp body 2, the sealed glass tube 29 or 29' is passed through the circular opening 12 or 12' of the bulb mounting plate 11 or 11' and the annular wall 6 or 6' of the rear wall of the lamp body 2 and projected into the interior of the chambered portion 4 or 4' to such a degree that the engaging lugs 35 or 35' abut on the rear surfaces of the arcuate lugs 16 or 16' of the bulb mounting plate 11 or 11'. Then, the electric bulb assembly 27 or 27' is turned about its axis in a clockwise direction in FIG. 1, that is, in a direction to bring the engaging lugs 35 or 35' to the guide slits 19 or 19' of the plate 11 or 11'. With this step, the engaging lugs 35 or 35' are slided into the guide slits 19 or 19' flexing the catch portions 17 or 17' rearward, and finally falled into the recesses 7 or 7' of the annular wall 6 or 6' and latchingly engaged with the same. Due to the biasing force applied to the engaging lugs 35 or 35' by the arcuate lugs 16 or 16', the electric bulb assembly 27 or 27' is tightly fixed tot he lamp body 2 without play. Furthermore, due to presence of the O-ring 36 or 36' thus compressed, the connection of the bulb assembly 27 or 27' to the lamp body 2 is made with a hermetical sealing therebetween.

Accordingly, the communication between the interior of the lamp body 2 and the outside of the same is made through only the air inlet and outlet pipes 23 and 22. The interiors 37 and 37' of the two chambered portions 4 and 4' are connected through an enclosed space which is defined between the lens 26 and each chambered portion.

As is understood from FIG. 1, upon mounting of the head lamp assembly 1A to a motor vehicle, the two pipes 23 and 22 are so oriented as taught by the drawing, that is, the air inlet pipe 23 is fixed to the connecting pipe 21 having the lower horizontal portion 23*c* thereof directed laterally outward and the lower vertical portion 23*d* directed downward, and the air outlet pipe 22 is fixed to the other connecting pipe 20 having the lower vertical portion 22*d* thereof directed downward and the oval opening of the obliquely cut lower end 24 thereof directed rearward of the vehicle.

When, in operation, the motor vehicle is under running, a certain wind pressure is applied to the exposed lower end 24 of the air outlet pipe 22 producing a negative pressure around the same. Thus, air in the interiors 37 and 37' of the lamp body 2 is enforcedly discharged therefrom through the air outlet pipe 22, while introducing fresh air thereinto through the air inlet pipe 23. Thus, ventilation is assuredly carried out in the lamp body 2 during movement of the vehicle. Thus, even if any moisture has been collected on the inner surfaces of the lens 26 and the reflector surface 3 due to energization of the electric bulbs, such moisture is instantly removed when the vehicle starts to move.

In accordance with the head lamp assembly 1A of the first embodiment,the following advantages are also given.

First, since the interior of the air inlet pipe 23 is provided with the baffles 25 by which a so-called labyrinth construction is defined in the pipe, foreign things, such as, water, dust and the like, are prevented from entering the interior of the lamp body 2. Furthermore,the provision of the baffles 25 in the air outlet pipe 22 brings about similar advantage. That is, even when the vehicle is idling or at rest, the considerable change of temperature in the lamp body 2, which is caused by On and OFF conditions of the electric bulbs therein, causes air breathing of the interior of the lamp body 2 through each pipe 23 or 22. The foreign matter stopping function is advantageous in keeping the inner surface of the lens 26 and the light reflecting surface 3 clean. However, experiment has revealed that the foreign thing stopping function is deteriorated when the inner diameter of the pipe 23 or 22 is greater than 10 mm.

Second, since each pipe 23 or 22 has several bent portions, the above-mentioned foreign things stopping function is much assured. Experiment has revealed that this function is much more assured when the entire length of the pipe 23 or 22 is increased.

Third, since each pipe 23 or 22 has at least one horizontal section 23*a*, 23*c*, 22*a* or 22*c* with the labyrinth structure, a so-called dust holding capacity of the pipe is increased.

Fourth, since the lower end 24 of the air outlet pipe 22 is obliquely cut, the same is prevented from collecting any drop of water which would plug the opening of the end 24. This is very important when considering that the plugging of the pipe breaks the ventilation in the lamp body 2. However, experiment has revealed that when the inner diameter of the pipe 22 or 23 is smaller than 5 mm, such plugging sometimes occurs.

Fifth, since the air inlet and outlet pipes 23 and 22 are detachably connected to the connecting pipes 21 and 20, replacement of the pipes 23 and 22 are easily carried out.

Referring to FIGS. 9 to 18, particularly FIGS. 9 to 12, there is shown an automotive head lamp assembly 1B of a second embodiment of the present invention.

As is seen from the drawings, the lamp assembly 1B of this embodiment is very similar to that of the aforementioned first embodiment 1A. Thus, only the parts and constructions different from those of the first embodiment 1A will be described in the following.

In the second embodiment 1B, the connecting pipes 21 and 20 are positioned at portions higher than those in the first embodiment 1A. Thus, in this case, unsightly portions of the pipes 21 and 20, which are exposed to the interior of the lamp body 2, are not viewed from the front of the head lamp assembly.

Furthermore, in this second embodiment 1B, there is no means which corresponds to the baffles 25 in the air inlet and outlet pipes 23 and 22, which are employed in the first embodiment 1A. This will be understood from FIG. 12 which shows the interior of the air outlet pipe 22 used in the second embodiment 1B.

However, in this second embodiment, because each pipe 23 or 22 has several bent portions,the foreign thing stopping function is also achieved, similar to the first embodiment 1A. Since the connecting pipes 21 and 20 are positioned away from the centers of the reflecting surfaces 3 and 3′ where the respective electric bulbs 27 and 27′ are positioned, they have substantially no affect on the light reflecting performance of the reflecting surfaces 3 and 3′.

Figure 13:
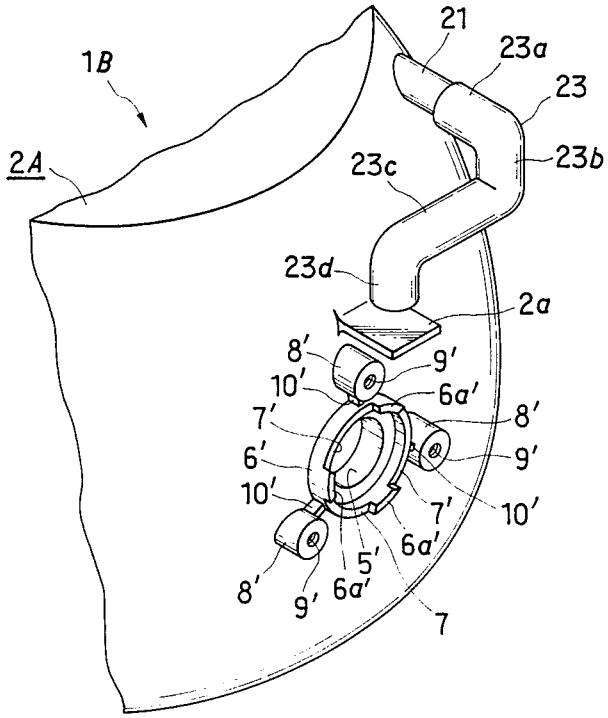

Referring to FIG. 13, there is shown a first modification 2A of the lamp body 2 of the second embodiment 1B. As is seen from the drawing, the lamp body 2A is integrally formed with a projected wall 2*a* which faces the mouth of the air inlet pipe 23 with a certain space therebetween. Because of the presence of the wall 2*a*, the mouth is prevented from sucking any foreign things.

Figure 14:
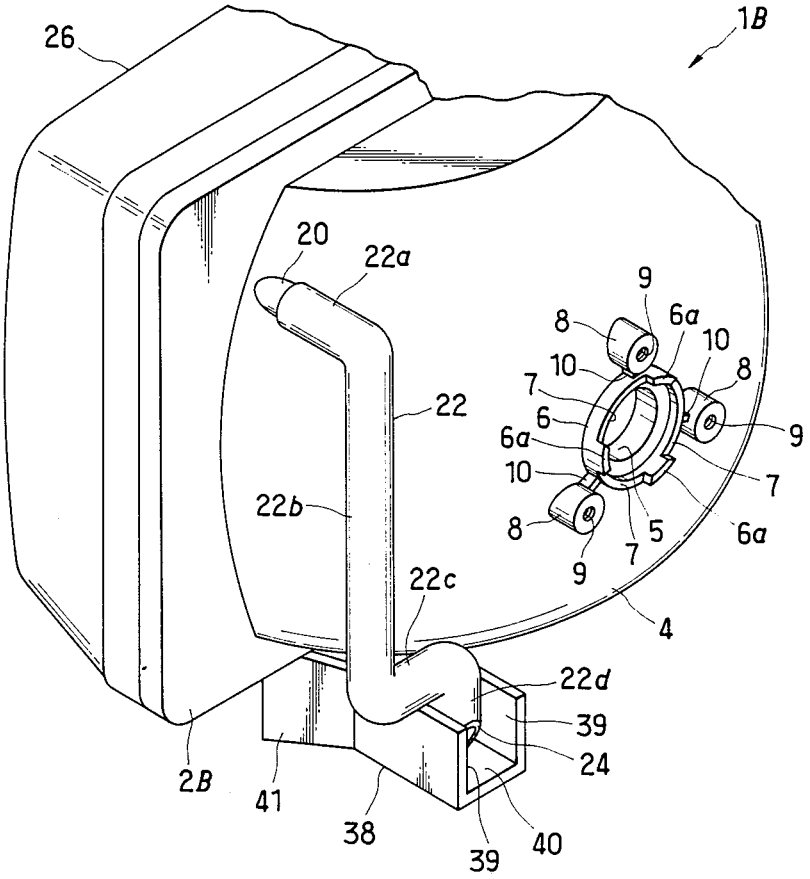
Figure 15:
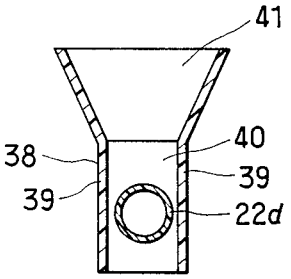

Referring to FIG. 14, there is shown a second modification 2B of the lamp body 2 of the second embodiment 1B. The lamp body 2B is provided with an air guide structure 38 comprising opposed side walls 39 and a bottom wall 40. These walls from a groove into which the obliquely cut lower end 24 of the air outlet pipe 22 is exposed. The front portion of the air guide groove is enlarged to form a funnel-shaped air inlet 41.

Because of the presence of the air guide structure 38 having the above-mentioned structure,the velocity of air flow, which passes through he lower end of the air outlet pipe 22 during moving of the vehicle, is increased, so that the negative pressure produced at the lower end of the pipe 22 is considerably increased. Thus, ventilation of the interior of the lamp body is more assured. If desired, the bottom wall 40 may be removed.

Figure 16:
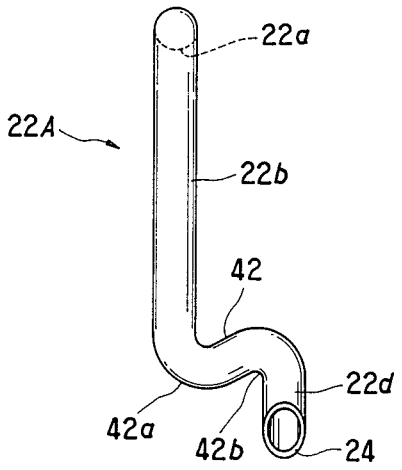

Referring to FIG. 16, there is shown a modification 22A of the air outlet pipe 22 of the second embodiment 1B. As is seen this drawing,t he portion 42 corresponding to the lower horizontal portion 22*c* of the pipe 22 shown in FIG. 14 is gradually raised as the distance from the lower end of the upper vertical portion 22*b* increases. Thus,the portion 42 has a lower upstream part 42*a* and an upper downstream part 42*b*. The foreign thing stopping function is much more assured in this construction. Of course, the air inlet pipe 23 may have a construction similar to that of the air outlet pipe 22A now mentioned.

Figure 17:
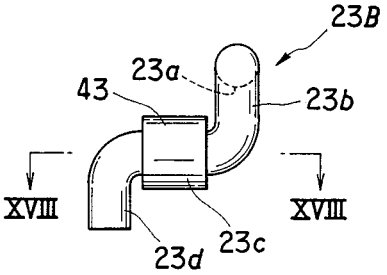
Figure 18:
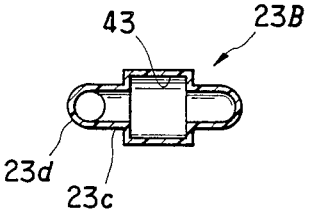

Referring to FIGS. 17 and 18, there is shown a modification 23B of the air inlet pipe 23 of the second embodiment 1B. As shown, the lower horizontal portion 23*c* of the pipe is formed with an enlarged chamber part 43. Because the velocity of air flow in the pipe 23 is suddenly decreased at this enlarged chamber part 43, any foreign things carried by the air flow are deposited or collected in this chamber part 43. This promotes the interior of the lamp body to be kept clean.

Figure 19:
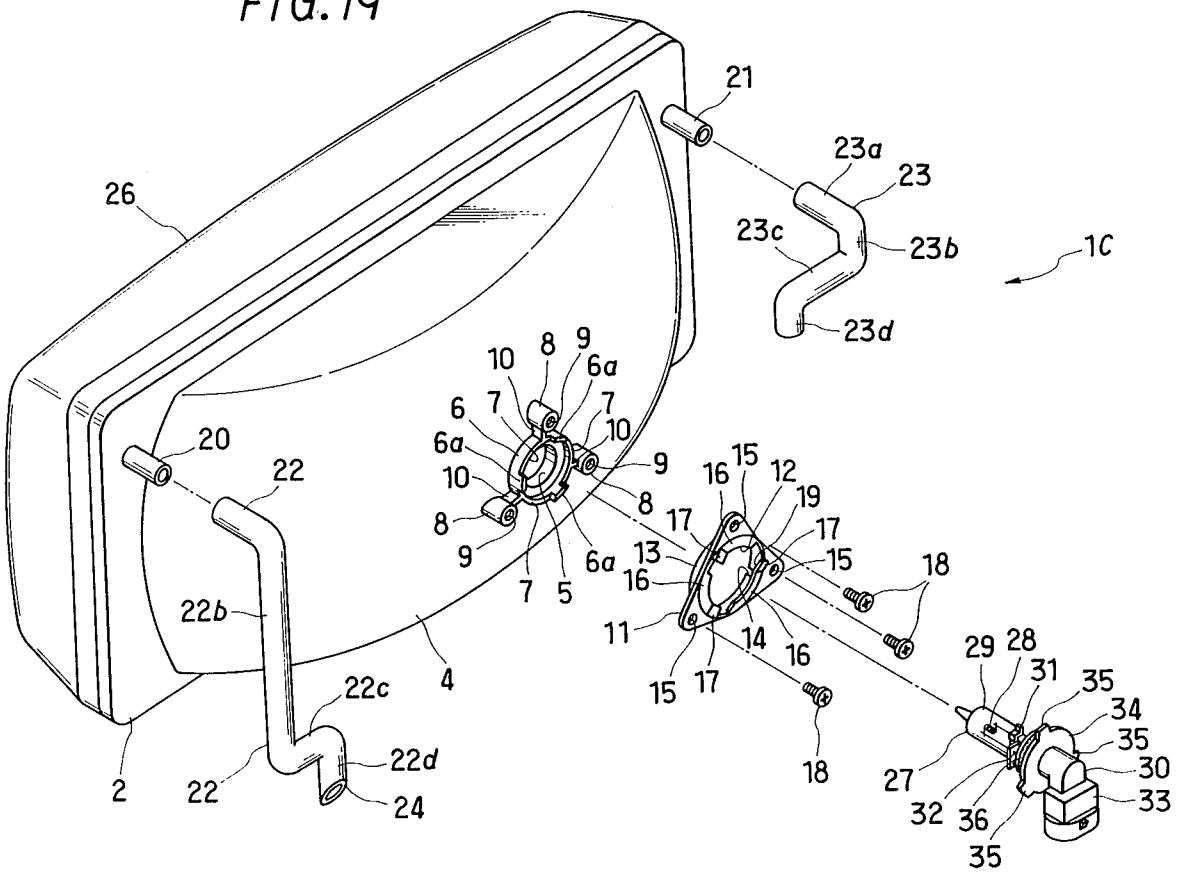
Figure 20:
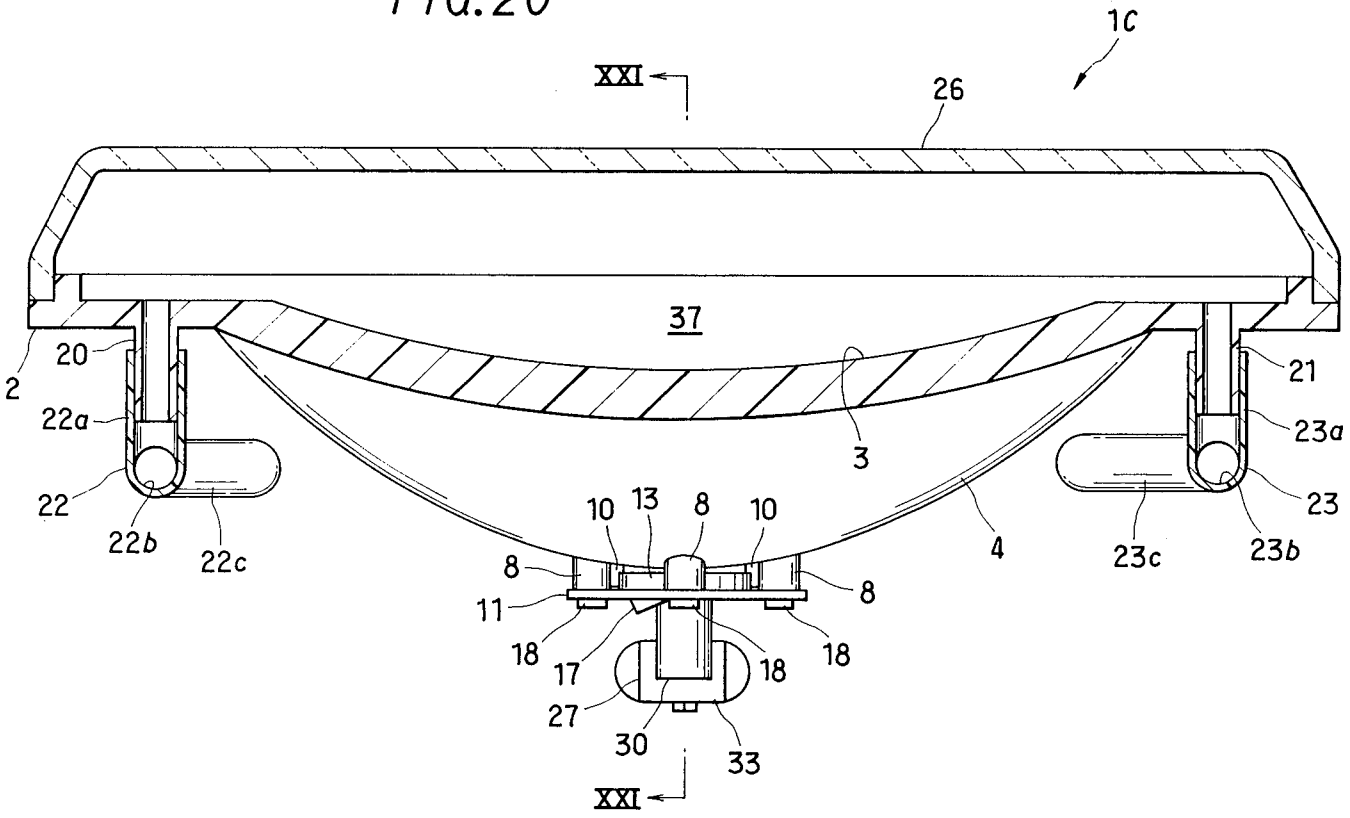
Figure 21:
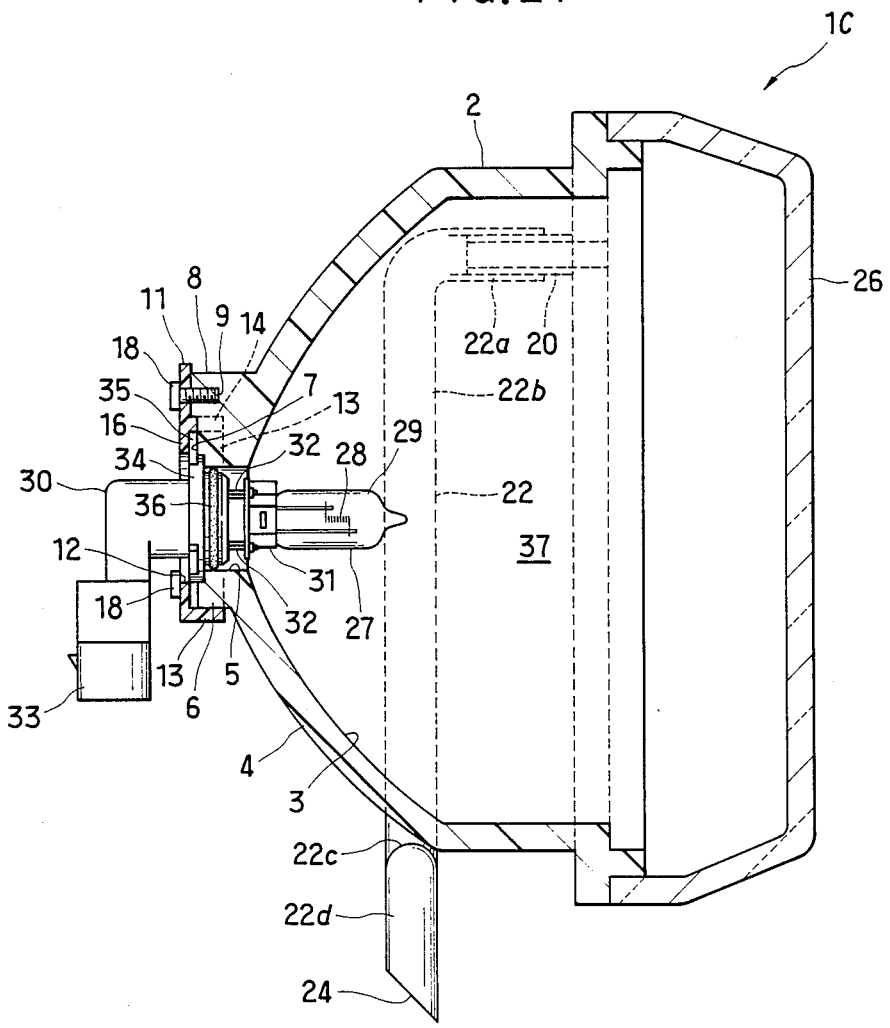

Referring to FIGS. 19 to 23, particularly FIGS. 19 to 21, there is shown an automotive head lamp assembly 1C of a third embodiment of the present invention. This assembly 1C is of a single lamp type, but very similar to one half part of the assembly of the second embodiment 1B of FIG. 9. Thus, the parts corresponding to those of the half part of the second embodiment 1B are designated by the same numerals and only the parts and constructions different from those of the second embodiment will be described in the following.

As is seen from FIG. 19, in the third embodiment 1C,the connecting pipes 21 and 20 for the air inlet an outlet pipes 23 and 22 are positioned at the peripheral upper flat sides of the rear wall of the lamp body 2, viz., the portions other than the swelled portion 4 wherein the light reflecting surface 3 is formed. Because the connecting pipes 21 and 20 do not interfere with the light reflecting surface 3 in the lamp body 2, the performance of the reflecting surface 3 is not deteriorated at all. Furthermore, since the connecting pipes 21 and 20 are positioned at the peripheral portion of the lamp body 2, the external appearance viewed from the front of the head lamp assembly 1C is not deteriorated. That is, the unsightly connecting pipes 21 and 20 projected into the interior of the lamp body 2 are concealed by a frame section of the lamp body 2.

Figure 22:
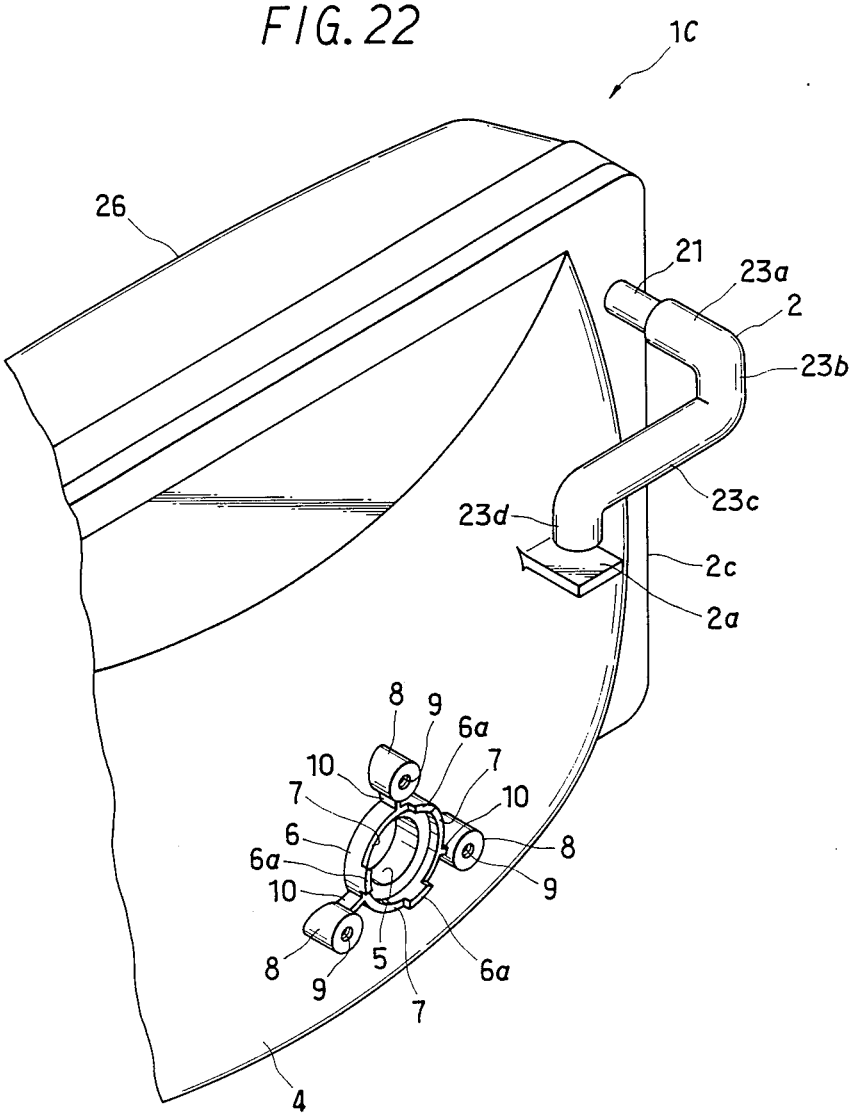

Referring to FIG. 22, there is shown a first modification 2C of the lamp body 2 of the third embodiment 1C. In this modification, a plate-like projection 2*a* formed on the rear wall of the lamp body faces the mouth of the air inlet pipe 23, similar to the case of FIG. 13.

Figure 23:
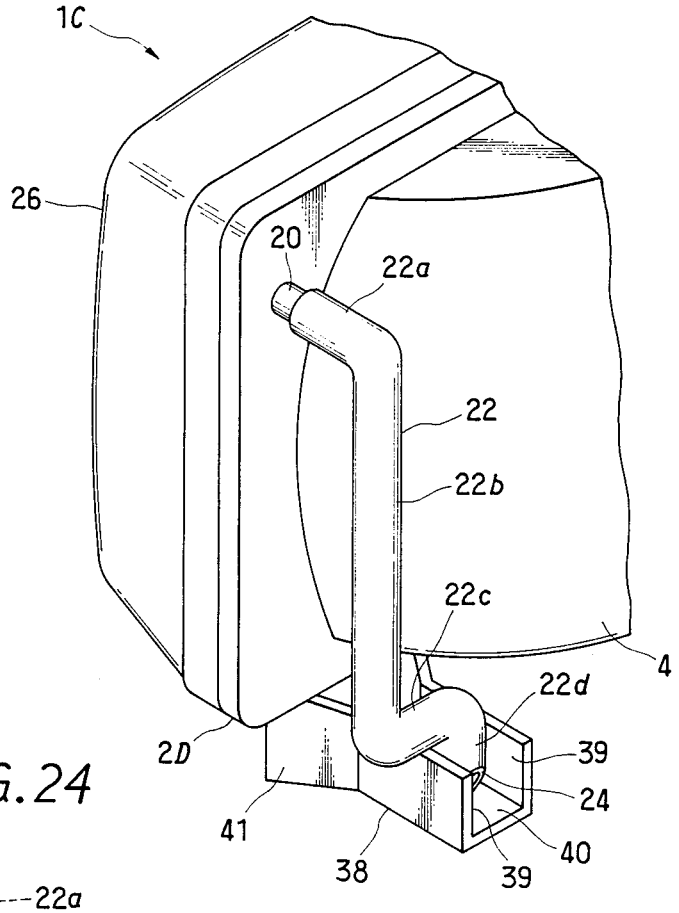

Referring FIG. 23, there is shown a second modification 2D of the lamp body 2 of the third embodiment 1C. Similar to the case of FIG. 14, an air guide structure 38 is provided for increasing the negative pressure generated around the lower end of the air outlet pipe 22.

Figure 24:
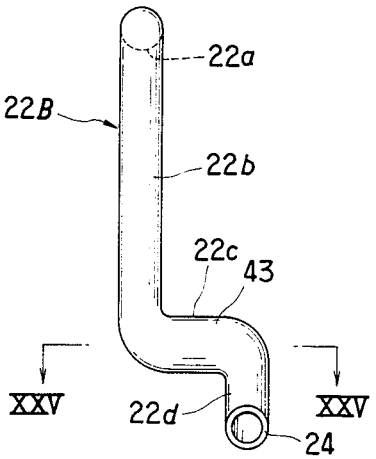
Figure 25:
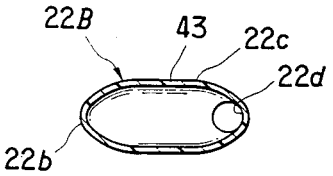

Referring to FIGS. 24 and 25, there is shown a modification 22B of the air outlet pipe 22 of the third embodiment 1C. As shown, the lower horizontal portion 22*c* of the pipe 22 is enlarged to form an enlarged chamber part 43. Of course, the air inlet pipe 23 may have a construction similar to that of the air outlet pipe 22B now mentioned. For the reason which has been described in the section of the second embodiment 2B (see FIGS. 17 and 18), the foreign thing stopping function is improved due to the presence of the enlarged chamber part 43.

Figure 26:
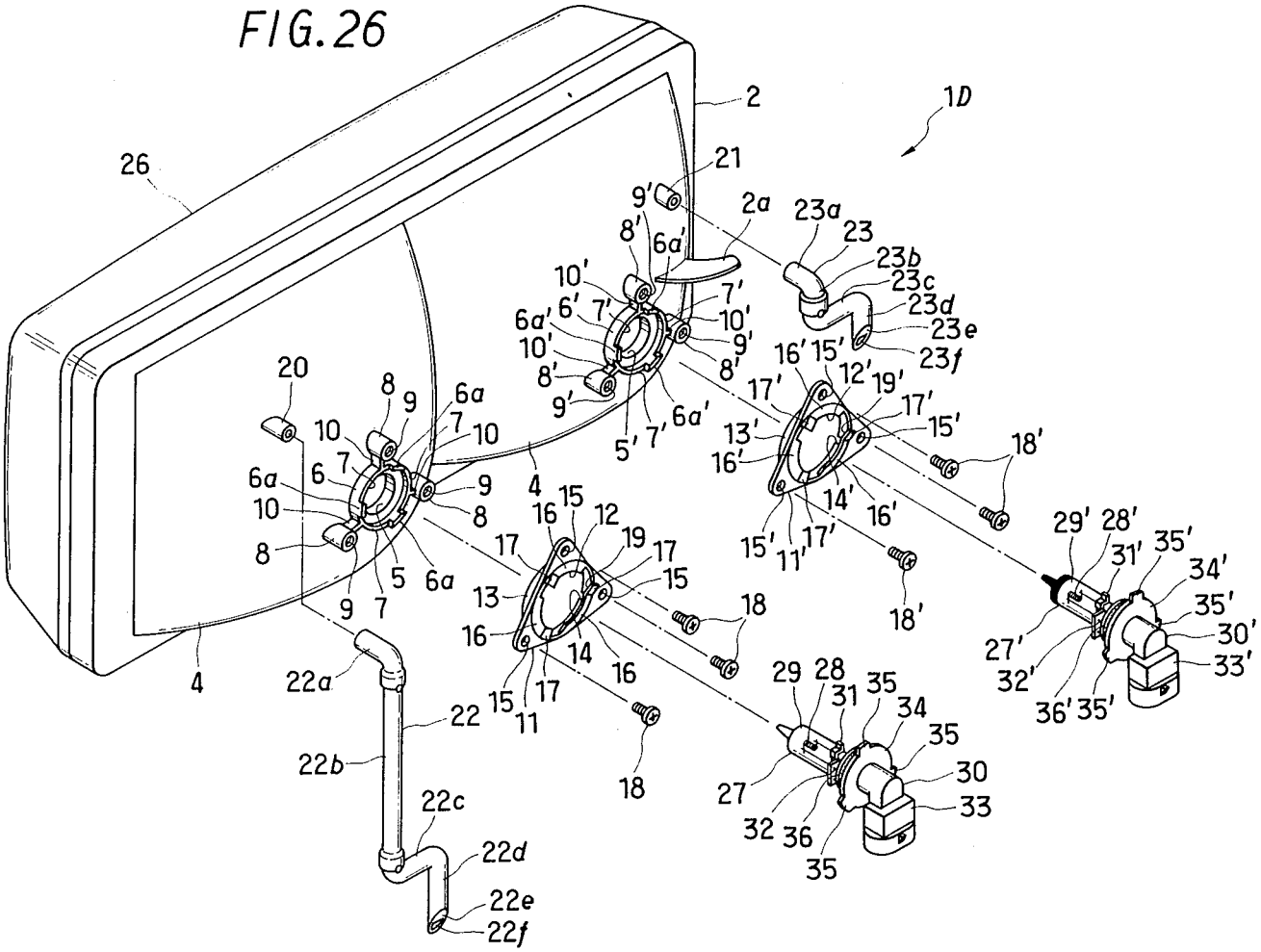
Figure 27:
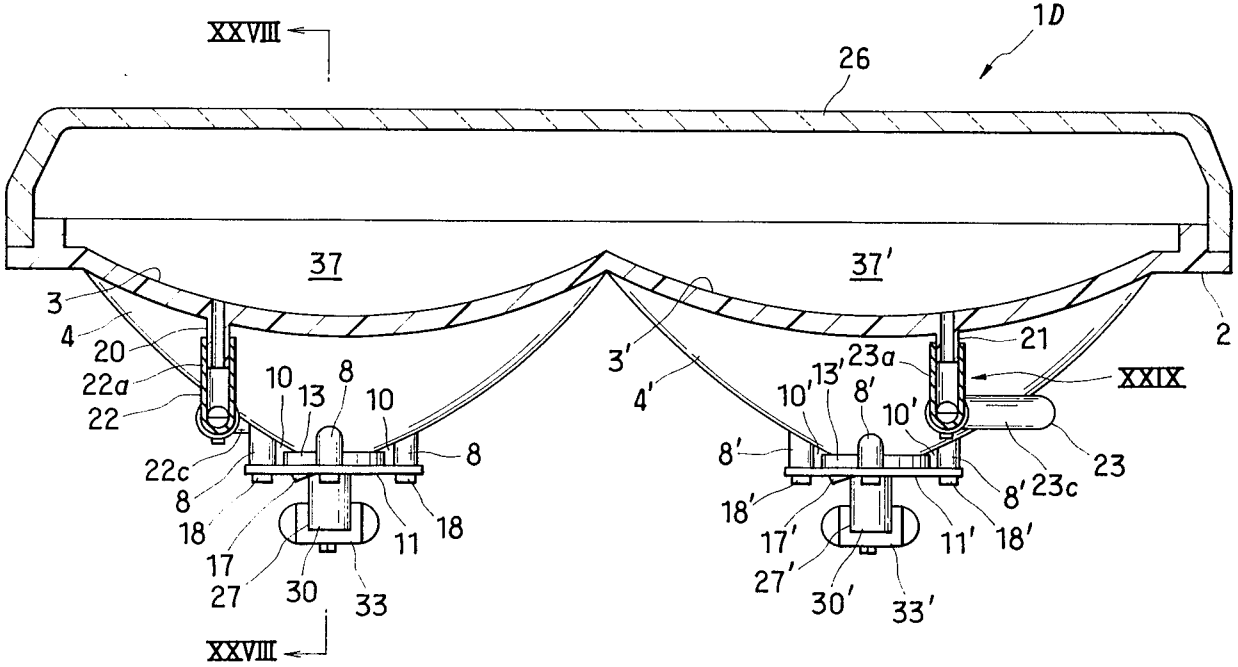
Figure 28:
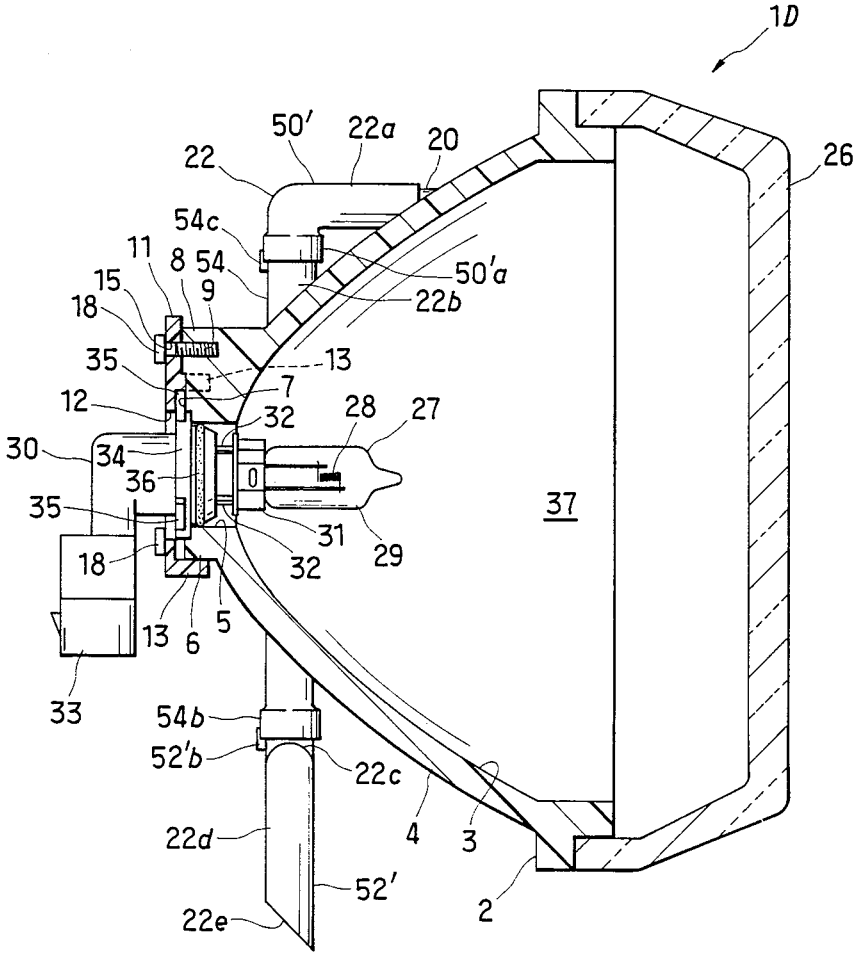

Referring to FIGS. 26 to 34, particularly FIGS. 26 to 28, there is shown a head lamp assembly 1D of a fourth embodiment of the present invention.

As is seen from the drawings, the lamp assembly 1D of this embodiment is very similar to that of the aforementioned first embodiment 1A. Thus, only the parts and construction different from those of the first embodiment 1A will be described in the following.

That is, in the fourth embodiment 1D, the lamp body 2 is integrally formed with a plate-like projection 2*a* which is incorporated with the air inlet pipe 23.

Furthermore, each of the air inlet and outlet pipes 23 and 22 employed in this embodiment is constructed of separate parts.

Figure 29:
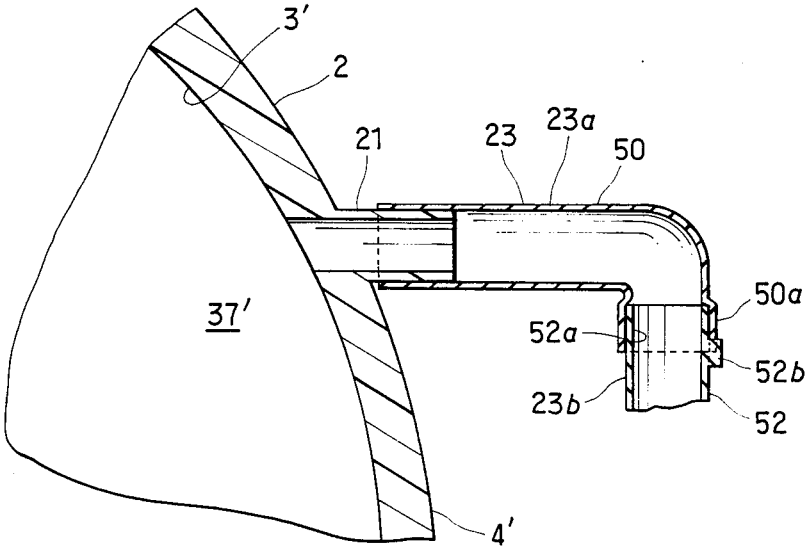
Figure 30:
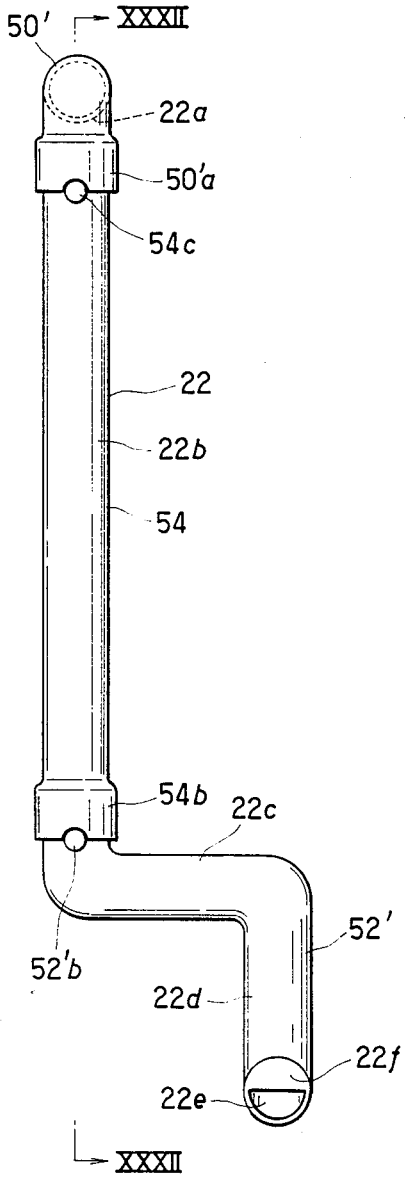
Figure 31:
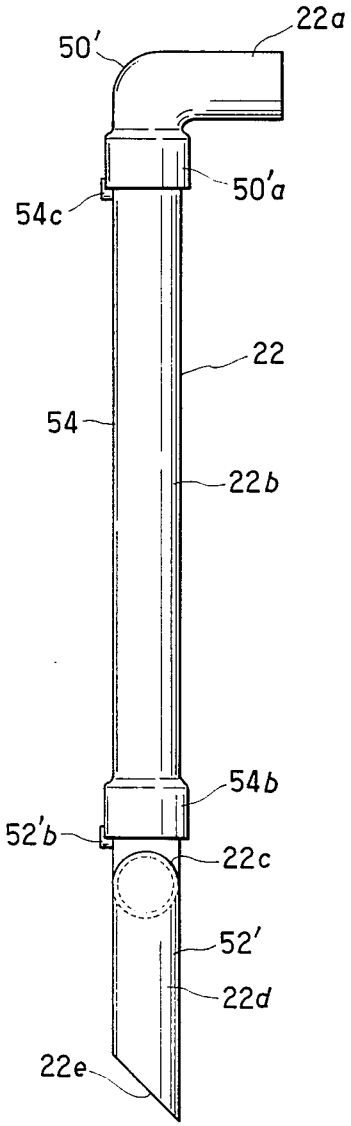
Figure 34:
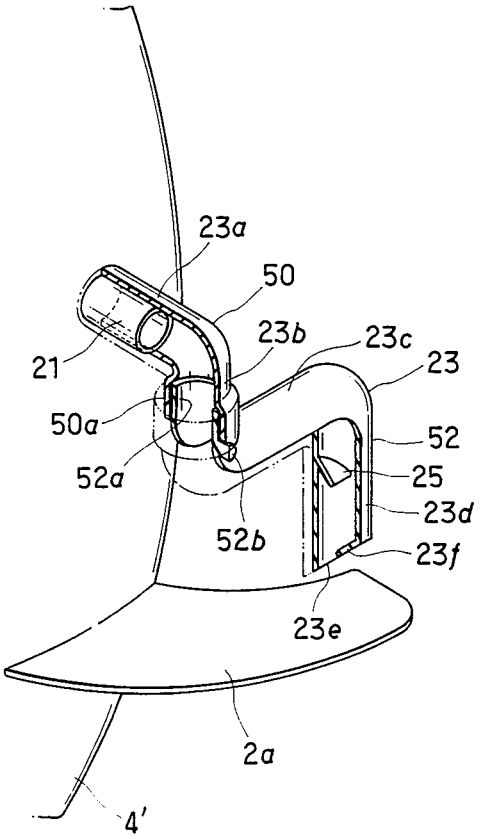

That is, as is best shown in FIGS. 29 and 34, the air inlet pipe 23 comprises two pipe parts 50 and 52 which are detachably connected with each other to constitute a pipe assembly which, similar to the air inlet pipe 23 used in the first embodiment 1A, comprises an upper horizontal portion 23*a*, an upper vertical portion 23*b*, a lower horizontal portion 23*c* and a lower vertical portion 23*d*. For detachably connecting the two pipe parts 50 and 52 are formed with mutually engageable jointing portions 50*a* and 52*a*. The pipe part 52 is formed with a small projection 52*b* which is engaged with a recess (no numeral) formed in the other pipe part 50 to achieve accuate relative placement therebetween. As is seen from FIG. 34, the lower end 23*e* of the pipe part 52 is obliquely cut to prevent collection of drop of water thereon. The mouth of the lower end 23*e* is half covered by a baffle 23*f*. Another baffle 25 is formed in the pipe part 52 at a position higher than the baffle 23*f*. With these baffles 23*f* and 25, the foreign thing stopping function is much assured.

Figure 32:
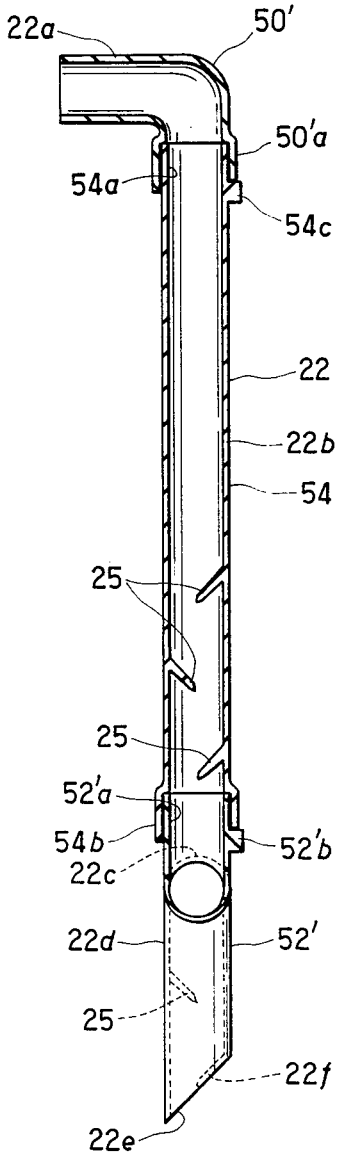
Figure 33:
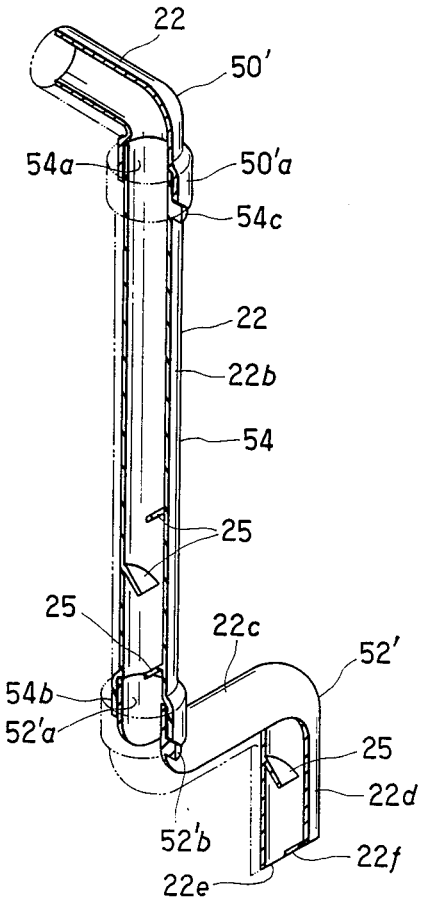

As is well shown in FIGS. 30 to 33, the air outlet pipe 22 comprises three pipe parts 50', 54 and 52' which are detachably connected to one another to constitute a pipe assembly which, similar to the air outlet pipe 22 used in the first embodiment 1A, comprises an upper horizontal portion 22*a*, an upper vertical portion 22*b*, a lower horizontal portion 22*c* and a lower vertical portion 22*d*. For connecting these three pipe parts 5', 54 and 52' in a snap action manner, these parts are formed with mutually engageable joining portions 50'*a*, 54*a*, 54*b* and 52'*a*. The lower end 22*e* of the pipe part 52' is obliquely cut and the oval opening of the lower end 22*e* is half covered by a baffle 22*f*. Another baffle 25 is formed in the pipe part 52', which is inclined toward the oval opening of the lower end 22*e*. As is best seen in FIG. 32, a plurality of inclined baffles 25 are formed within the straight pipe 54, which are projected inwardly from diametrically opposed inner walls of the pipe 54 and arranged alternatively. Each baffle 25 is so sized as to extend beyond the center axis of the pipe 54. With these baffles 22*f* and 25, the foreign thing stopping function is assured. The pipe parts 54 and 52' are formed with small projections 54 and 52'*b* for achieving accuate relative placements between the three pipe parts 50', 54 and 52'.

According to this fourth embodiment 1D, cleaning of the pipe assemblies 23 and 22 is easily achieved because of the same can be easily disassembled into separate parts. Furthermore, the parts for the air inlet pipe assembly 23 and those for the air outlet pipe assembly 22 can be used commonly.

As will be understood from the foregoing description, the automotive lamp assembly of the present invention has various advantages which have not been expected from the conventional ventilation type lamp assemblies.

What is claimed is:

1. An automotive lamp assembly comprising:
a body structure having an open chamber formed therein;
a lens attached to said body structure to cover said open chamber thereby to form an enclosed chamber in said body structure;
an electric bulb arranged in said enclosed chamber;
a first pipe member having one end projected into a first given portion of said enclosed chamber and the other end open to the atmosphere;
a second pipe member having one end projected into a second given portion of said enclosed chamber and the other end open to the atmosphere; and
means for producing a negative pressure in the other end of said second pipe member when a certain air flow passes through the same.

2. An automotive lamp assembly as claimed in claim 1, in which said means comprises an obliquely cut portion formed at the other end of said second pipe member.

3. An automotive lamp assembly as claimed in claim 2, in which said first and second pipe members are connected to said enclosed chamber through respective connecting pipes which are connected to a rear wall of said body structure.

4. An automotive lamp assembly as claimed in claim 2, in which the other end of said first pipe member is placed within a given zone which is defined by a projected plane of said body structure and in which the other end of said second pipe member is placed away from said given zone.

5. An automotive lamp assembly as claimed in claim 4, in which said second pipe member is longer than said first pipe member.

6. An automotive lamp assembly as claimed in claim 5, in which the other end of said second pipe member extends beyond a peripheral portion of said body structure.

7. An automotive lamp assembly as claimed in claim 6, further comprising a light reflecting surface which constitutes a rear part of said enclosed chamber for reflecting light from said electric bulb toward said lens.

8. An automotive lamp assembly as claimed in claim 7, in which said light reflecting surface is parabolically curved and has a center at which said electric bulb is positioned.

9. An automotive lamp assembly as claimed n claim 8, in which said first and second given portions of said enclosed chamber are laterally spaced from each other and positioned away from said center of the parabolically shaped light reflecting surface.

10. An automotive lamp assembly as claimed in claim 9, in which said first and second given portion are positioned away from said parabolically shaped light reflecting surface.

11. An automotive lamp assembly as claimed in claim 7, in which at least one of said first and second pipe members is shaped to have bent portions thereby to form in the interior thereof a zig-zag passage.

12. An automotive lamp assembly as claimed in claim 11, in which at least said first pipe member is shaped to have bent portions.

13. An automotive lamp assembly as claimed in claim 12, in which each of said first and second pipe members comprises an upper horizontal portion, an upper vertical portion extending downward from an end of said upper horizontal portion, a lower horizontal portion extending horizontally from a lower end of said upper vertical portion and a lower vertical portion extending downward from a leading end of said lower horizontal portion.

14. An automotive lamp assembly as claimed in claim 13, in which each of said first and second pipe members comprises separate pipe parts which are detachably connected to one another.

15. An automotive lamp assembly as claimed in claim 14, in which said separate parts of each of said first and second pipe members are connected to one another in a snap action manner.

16. An automotive lamp assembly as claimed in claim 12, in which at least one of said first and second pipe members is formed with a plurality of baffles which are arranged in the interior of the pipe member to form a labyrinth structure in the same.

17. An automotive lamp assembly as claimed in claim 16, in which said baffles are projected from diametrically opposed inner walls of the interior of each pipe member alternatively.

18. An automotive lamp assembly as claimed in claim 17, in which said baffles are integral with the pipe member and inclined toward the other end of the pipe member.

19. An automotive lamp assembly as claimed in claim 18, in which each baffle extends beyond a center axis of the pipe member.

20. An automotive lamp assembly as claimed in claim 18, in which an oval opening formed in the other end of each pipe member is half covered by a baffle which is integral with said pipe member.

21. An automotive lamp assembly as claimed in claim 1, in which the other end of said first pipe member faces a plate-like projection integrally formed on the rear surface of said body structure.

22. An automotive lamp assembly as claimed in claim 21, in which the other end of said second pipe member is incorporated with an air guide structure by which the velocity of the air flow passing through said other end is increased.

23. An automotive lamp assembly as claimed in claim 22, in which said air guide structure comprises a groove member into which said other end is exposed, and a funnel-like member connected to one end of said groove member.

24. An automotive lamp assembly as claimed in claim 23, in which said air guide structure is integral with said body structure.

25. An automotive lamp assembly as claimed in claim 13, in which at least one of said first and second pipe members is formed at said lower horizontal portion with an enlarged portion, said enlarged portion having therein a passage the diameter of which is greater than that in the other portion of the pipe member.

26. An automotive lamp assembly as claimed in claim 13, in which said lower horizontal portion of each pipe member is so bent as to define an acute angle between it and said upper vertical portion.

27. An automotive lamp assembly as claimed in claim 10, in which said first and second given portions are upper portions of said body structure with respect to said light reflecting surface.

28. An automotive lamp assembly comprising:

a body structure having an open chamber formed therein;

a lens attached to said body structure to cover said open chamber thereby to form an enclosed chamber in said body structure;

an electric bulb arranged in said enclosed chamber;

a first pipe member having one end projected into said enclosed chamber and the other end open to the atmosphere;

a second pipe member having one end projected into said enclosed chamber and the other end open to the atmosphere, the other end of the second pipe member being cut obliquely and extending outwardly beyond a peripheral portion of said body structure; and a plurality of baffles formed in the interior of each pipe member in a manner to constitute a labyrinth therein.

29. An automotive lamp assembly as claimed in claim 28, in which said baffles are projected from diametrically opposed inner walls of the pipe member and arranged alternatively, and in which each baffle extends beyond a center axis of the pipe member.

30. An automotive lamp assembly as claimed in claim 29, further comprising a parabolically shaped light reflecting surface which is arranged in said enclosed chamber in a manner to face an inner surface of said lens.

31. An automotive lamp assembly comprising:

a body structure having an open chamber formed therein;

a lens attached to said body structure to cover said open chamber thereby to form an enclosed chamber in said body structure;

an electric bulb arranged in said enclosed chamber;

first and second pipe members each having one end projected into said enclosed chamber and the other end open to the atmosphere, each pipe member having at least two bent portions; and means for producing a negative pressure in the other end of said second pipe member when a certain air flow passes through the same.

32. An automotive lamp assembly as claimed in claim 31, in which said means comprises an obliquely cut portion defined by the other end of said second pipe member, said second pipe member extending beyond a peripheral portion of said body structure.

33. An automotive lamp assembly as claimed in claim 32, further comprising a parabolically shaped light reflecting surface which is arranged in said enclosed chamber in a manner to face an inner surface of said lens.

34. An automotive lamp assembly comprising:

a body structure having an open chamber formed therein;

a lens attached to said body structure to cover said open chamber thereby to form an enclosed chamber in said body structure;

a parabolically shaped light reflecting surface arranged in said enclosed chamber in a manner to face an inner surface of said lens;

a dummy portion exposed to the interior of said enclosed chamber and surrounding the peripheral portion of said light reflecting surface;

an electric bulb arranged in said enclosed chamber; and first and second pipe members, each having one end projected into said enclosed space through said dummy portion and the other end exposed to the atmosphere, the other end of said second pipe member being obliquely cut and extending outwardly beyond a peripheral portion of said body structure.

35. An automotive lamp assembly as claimed in claim 34, in which each of said first and second pipe members has at least two bent portions so as to form in the pipe member a zig-zag passage.

36. An automotive lamp assembly as claimed n claim 35, in which an oval opening formed in the other end of said second pipe member faces rearward with respect to said body structure.

37. An automotive lamp assembly comprising:

a body structure having an open chamber formed therein;

a lens attached to said body structure to cover said open chamber thereby to form an enclosed chamber in said body structure;

an electric bulb arranged in said enclosed chamber;

first and second pipe members, each having one end projected into the enclosed chamber and the other end exposed to the atmosphere, and a plurality of baffles formed in each of said first and second pipe members in a manner to form in the same a labyrinth structure, each baffle being inclined toward the other end of the pipe member, wherein the other end of said second pipe member is cut obliquely and oriented in a manner to direct an oval opening thus formed in a direction away from said body structure, and wherein one of said baffles is arranged to halfly cover the oval opening of the other end of the second pipe member.

38. An automotive lamp assembly as claimed in claim 37, in which said baffles are arranged alternatively, in each pipe member.

39. An automotive lamp assembly as claimed in claim 38, in which each of said first and second pipe member is constructed of an elastomeric material.

40. An automotive lamp assembly as claimed in claim 38, in which each of said first and second pipe members is constructed of rubber or plastics.

* * * * *

UNITED STATES PATENT AND TRADEMARK OFFICE

CERTIFICATE OF CORRECTION

PATENT NO. : 4,862,337

DATED : August 29, 1989

INVENTOR(S) : Hirohiko Ohshio et al.

It is certified that error appears in the above-identified patent and that said Letters Patent is hereby corrected as shown below:

On the head sheet at [75] correct the spelling of the second inventor's first name to read --Hiroyuki In claim 36, line 1, change n to read --in--.

Signed and Sealed this

Eighth Day of January, 1991

*Attest:*

HARRY F. MANBECK, JR.

*Attesting Officer*

*Commissioner of Patents and Trademarks*